US007472894B2

(12) United States Patent
Shedd et al.

(10) Patent No.: US 7,472,894 B2
(45) Date of Patent: Jan. 6, 2009

(54) ENGINE CARBURETION

(75) Inventors: Timothy A. Shedd, Madison, WI (US); Wayne L. Staats, Mequon, WI (US); Terry L. Hendricks, Milwaukee, WI (US)

(73) Assignee: Wisconsin Alumni Research Foundation, Madison, WI (US)

( * ) Notice: Subject to any disclaimer, the term of this patent is extended or adjusted under 35 U.S.C. 154(b) by 294 days.

(21) Appl. No.: 11/426,946

(22) Filed: Jun. 28, 2006

(65) Prior Publication Data

US 2008/0001315 A1 Jan. 3, 2008

(51) Int. Cl.
*F02M 19/03* (2006.01)

(52) U.S. Cl. ..... 261/121.3; 261/DIG. 55

(58) Field of Classification Search ..... 261/121.3, 261/DIG. 55
See application file for complete search history.

(56) References Cited

U.S. PATENT DOCUMENTS

| | | | | | |
|---|---|---|---|---|---|
| 1,586,671 | A | * | 6/1926 | Gustafson et al. | 261/35 |
| 1,671,817 | A | * | 5/1928 | Ducamp | 261/121.3 |
| 1,733,730 | A | * | 10/1929 | Haling | 261/41.5 |
| 1,994,944 | A | * | 3/1935 | Cole | 261/34.2 |
| 2,625,142 | A | * | 1/1953 | Chambers | 123/530 |
| 2,750,168 | A | * | 6/1956 | Winkler | 261/41.5 |
| 2,797,905 | A | * | 7/1957 | Olson | 261/41.1 |
| 3,387,831 | A | * | 6/1968 | Brown et al. | 261/51 |
| 3,706,444 | A | * | 12/1972 | Masaki et al. | 261/39.5 |
| 3,780,996 | A | * | 12/1973 | Nutten | 261/72.1 |
| 3,995,609 | A | | 12/1976 | Klomp | |
| 4,060,573 | A | | 11/1977 | Mori et al. | |
| 4,114,372 | A | | 9/1978 | Ikeura | |
| 4,212,275 | A | | 7/1980 | Inoue | |
| 4,229,387 | A | | 10/1980 | Rogerson et al. | |
| 4,240,989 | A | | 12/1980 | Moriyama et al. | |
| 4,269,793 | A | | 5/1981 | Ibbott | |
| 4,298,548 | A | | 11/1981 | Pontoppidan | |
| 4,432,324 | A | | 2/1984 | Ishikawa et al. | |
| 4,584,834 | A | | 4/1986 | Koshoffer et al. | |
| 5,223,180 | A | * | 6/1993 | Yost | 261/41.1 |
| 5,231,968 | A | | 8/1993 | Siefkes | |
| 6,435,482 | B1 | | 8/2002 | Omi et al. | |
| 6,609,704 | B2 | | 8/2003 | Satterfield | |
| 6,851,663 | B2 | | 2/2005 | Satterfield | |
| 6,871,843 | B2 | * | 3/2005 | Abei et al. | 261/41.5 |
| 6,941,925 | B2 | | 9/2005 | Yamada | |
| 2003/0160341 | A1 | * | 8/2003 | Satterfield | 261/62 |

FOREIGN PATENT DOCUMENTS

| | | | | | |
|---|---|---|---|---|---|
| JP | 2-91465 | A | * | 3/1990 | 261/121.3 |

* cited by examiner

*Primary Examiner*—Richard L Chiesa
(74) *Attorney, Agent, or Firm*—Craig A. Fieschko, Esq.; DeWitt Ross & Stevens S.C.

(57) ABSTRACT

An emulsion tube for a carburetor is formed with a porous wall surrounding an inner passage, wherein air travels about one side of the wall and fuel travels about the opposite side, with air being supplied through the pores to aerate the fuel (with the aerated fuel then being expelled into a venturi wherein engine intake air is traveling to further mix the fuel with the intake air therein). The emulsion tube can beneficially provide a high degree of fuel/air mixing across the entire range of intake airstream flow rates at which an engine may operate. The porosity of the emulsion tube can also be tailored to provide the desired fuel/air ratio(s) across the engine's operational range of intake airstream flow rates.

22 Claims, 1 Drawing Sheet

ENGINE CARBURETION

STATEMENT REGARDING FEDERALLY SPONSORED RESEARCH

This invention was made with United States government support awarded by the following agencies:

NSF Grant No(s).: 0134510

The United States has certain rights in this invention.

FIELD OF THE INVENTION

This document concerns an invention relating generally to carburetors, and more specifically to emulsion tubes for carburetors.

BACKGROUND OF THE INVENTION

Spark ignition (SI) engines, wherein fuel and air are provided to a cylinder and ignited by a spark, have conventionally been provided with fuel and air by either carburetion or by fuel injection. In fuel injection, one or more injectors squirt fuel into the cylinder(s) of the engine, and/or into the cylinder air intake port(s), with the object of atomizing the fuel and mixing it with the air to better enable ignition of the fuel. In carburetion, fuel is supplied into the intake airstream entering the engine and its cylinders, generally at a venturi (a necked passage) which generates suction to pull fuel into the intake airstream in accordance with the flow rate of the intake airstream. Since the air/fuel mixture has a major impact on engine performance and pollutant emissions, the goal of both carburetion and fuel injection is to attain the desired fuel-air mixture at the desired time within the engine cylinder(s). Carburetion systems have the advantage of being rather easily and inexpensively manufactured, but they have the disadvantage that they offer only crude control over the degree of air/fuel mixing, the air/fuel ratio, and the timing of the air/fuel charge entering the cylinder(s). As a result, carburetors tend to offer lesser fuel economy and greater pollutant emissions than fuel injection systems, which is why many modern SI engines (e.g., automotive SI engines) use fuel injection. However, in some applications—in particular for small engines (which are typically regarded as engines having an output of less than 25 horsepower)—carburetion is still commonly used simply because the cost of implementing fuel injection in small engine applications (e.g., lawnmowers, snowthrowers, chainsaws, and other small tools and vehicles) would increase their costs to levels unaffordable to many consumers. Thus, small engines have a reputation (often deserved) for being "dirty" and inefficient. It would therefore be useful to have means available for efficiently and economically enhancing carburetion quality so as to reduce these disadvantages.

SUMMARY OF THE INVENTION

The invention, which is defined by the claims set forth at the end of this document, is directed to emulsion tubes for carburetors (and to carburetors incorporating such emulsion tubes) which at least partially alleviate the aforementioned problems. To give the reader a basic understanding of the invention, following is a brief summary of an exemplary version of the invention, with the summary referring to the accompanying drawings. Since this is merely a summary, it should be understood that more details regarding the preferred versions may be found in the Detailed Description set forth elsewhere in this document. The claims set forth at the end of this document then define the various versions of the invention in which exclusive rights are secured.

Looking to FIG. 1, which presents a schematic view of a section of an exemplary carburetor 10 for an internal combustion engine, a venturi 12 has a narrowed throat 14 through which intake air flows from an air supply 16 to enter the intake valves of the engine (with neither the engine nor the valves being depicted). The carburetor 10 also includes a fuel supply 18 which may receive fuel from a source such as a fuel tank, with fuel here being metered into the fuel supply 18 via a float 20 mounted on a spring 22. An emulsion tube 100 then extends within a well 24 from the fuel supply 18 to the venturi 12, and it includes an elongated tubular body 102 having an outer surface 104, an opposing inner surface 106 surrounding an inner passage 108, and opposing first and second openings 110 and 112 between which the inner passage 108 extends. The inner passage 108 of the emulsion tube 100 communicates fuel from the lower portion 26 of the well 24 (and from the fuel supply 18) to the venturi 12, with the low pressure within the venturi 12 pulling fuel from the fuel supply 18 so that the fuel may be carried by the intake air into the engine. A high-pressure air passage 28 can be provided which leads from a high-pressure area in the intake airstream path, e.g., an area situated upstream from the narrowed throat 14 of the venturi 12, to the upper portion 30 of the well 24 and to an area of the tubular body 102 between its first and second openings 110 and 112. As a result, the high-pressure air at the upper portion 30 of the well 24 assists in pushing fuel through the emulsion tube 100 to the venturi 12.

Thus far, such an arrangement is relatively conventional. An objective of this arrangement is to provide a fuel flow rate which is roughly proportional to the intake airstream flow rate, so as to provide a relatively constant air-fuel ratio regardless of the engine speed and the resulting intake airstream flow rate. However, owing to the compressibility of air and other factors, a desired air-fuel ratio can be difficult to obtain across the engine's operational range of intake airflow rates. To compensate for these factors, the emulsion tube 100 may have one or more holes drilled from its outer surface 104 to its inner passage 108 along the upper portion of the well 24, with the holes accepting air from the high-pressure air passage 28 into the fuel stream traveling in the inner passage 108. When such holes are properly sized and spaced, they can assist in tailoring the fuel-air ratio as desired across the range of intended engine intake airstream flow rates. Emulsion tubes of this nature still tend to suffer from the disadvantage that they fail to attain the desired degree of mixing across at least a portion of the engine's operational range of intake airstream flow rates, with the fuel leaving the emulsion tube as a trailing stream or as large droplets rather than as a finely-atomized spray. This often occurs at least in part because the two-phase gas/liquid flow in the emulsion tube tends to transition between distinctly different types of flow as the flow rate changes from low to high (e.g., between known two-phase flow regimes such as dispersed bubble flow, churn flow, annular flow, bridging flow, slug flow, etc.), and certain flow regimes result in good atomization whereas others do not. Poorly-dispersed fuel can then lead to further ill effects; for example, the exiting fuel droplets/streams may impinge on the walls of the venturi and pool downstream from the emulsion tube, with fuel dripping off of the venturi and entering the engine cylinder(s) at irregular times. Thus, even though a desired amount of fuel may be exiting the emulsion tube, it may not result in the desired air/fuel mixture actually entering the engine cylinder(s). Further, the nonuniform mixing of the air/fuel mixture accepted into the cylinder(s), arriving as a collection of large amorphous droplets or other agglomerations of fuel rather than as a more homogeneous atomized spray, can lead to less efficient combustion and greater pollutant emissions.

The invention at least partially overcomes these drawbacks by forming at least a portion of the tubular body 102 of the emulsion tube 100 of porous material such as sintered metal, with multiple pores extending through the tubular body 102 from the outer surface 104 to the inner surface 106 to open upon the inner passage 108. The pores preferably have an average diameter of less than about 0.5 mm, and more preferably less than about 100 micrometers (0.1 mm). So long as such pores are adjacent the upper portion of the well 24 (the portion supplied by the high-pressure air passage 28), air will enter the fuel stream traveling along inner passage 108 of the tubular body 102 and aerate it. This has been found to result in extremely good atomization of the fuel stream, with the fuel stream exiting the tubular body 102 as a foamy and far more homogeneous mixture.

It may then be necessary to configure the tubular body 102 of the emulsion tube 100, and/or to tailor its porosity, so that the air-fuel ratio has the desired relationship with respect to the intake airstream flow rate in the venturi 12 (e.g., to obtain a relatively constant air-fuel ratio across the operational range of intake airstream flow rates). This can be done, for example, in the manner of the emulsion tube 200 of FIG. 2, wherein the porous tubular body 202 is configured with a thickness which varies along its length, and thereby has a varying pressure drop between its outer surface 204 and its inner passage 208. Here, assuming the porous tubular body 202 has uniform porosity, circumferential admittance of air and/or fuel is greater nearer the first opening 210 owing to lesser thickness of the tube (and thus a lower pressure drop across the tube wall). FIG. 3 illustrates a similar arrangement, but here the inner passage 308 has varying diameter, unlike the arrangement of FIG. 2 where the outer surface 204 varies in diameter while the inner passage 208 remains constant. The arrangement of FIG. 3 can have the further effect of accelerating the air-fuel mixture as it travels from the first opening 310 to the second opening 312 (or decelerating the air-fuel mixture, if the tubular body 302 is installed with the second opening 312 in the venturi 12), and at the same time the emulsion tube 300 is more amenable to retrofitting within preexisting carburetors which might not accept an externally tapered emulsion tube (as with the emulsion tube 200 of FIG. 2). Other more complex configurations are also possible, as exemplified by FIG. 4, wherein the tubular body 402 of the emulsion tube 400 starts with a relatively uniform tube thickness near its first opening 410, with the inner passage 408 then necking inwardly before expanding outwardly at the second opening 412.

Alternatively and/or additionally, the pore sizes and/or densities may vary at different locations along the length of the tubular body. For example, FIG. 5 illustrates an emulsion tube 500 having tube wall pressure drops similar to those of the emulsion tubes 200 and 300, with greater pore density and/or greater average pore diameter nearer the first opening 510, and decreasing density and/or pore diameter approaching the opposing second opening 512. Such variable-porosity tubes can be manufactured, for example, by sintering together particles whose diameters vary in accordance with their location along the length of the tube (e.g., larger diameter particles, and thus larger pores, near the first opening 510, and smaller diameter particles, and thus smaller pores, near the second opening 512). Since variable-porosity tubes can be difficult and expensive to construct, an alternative arrangement is illustrated in FIG. 6, wherein the emulsion tube 600 is formed of a tubular body 602 in three joined axially-aligned sections 614 which are substantially identical save for their porosity (i.e., they each have different average pore sizes and/or densities, for example, the sections 614 might have pore sizes which increase by 3 micrometers or more with each successive section 614). In this case, porosity varies discretely rather than continuously over the length of the tubular body 602.

The porous emulsion tube 100 has been found in experiments to result in generation of a foamy "bubbly flow" across the entire operating range of air intake flow rates of common carburetors, with a very well-mixed emulsion at the exit of the emulsion tube 100, one which is far superior to that produced with conventional prior emulsion tubes. Further, with appropriate tailoring of the porosity of the emulsion tube 100 (as dictated by flow modeling, computerized simulation, and/or by trial and error), the emulsion tube 100 can be made to provide a linear (or other) relationship between fuel flow and air intake flow, as in conventional emulsion tubes. Further features and advantages of the invention will be apparent from the remainder of this document in conjunction with the associated drawings.

DETAILED DESCRIPTION OF PREFERRED VERSIONS OF THE INVENTION

Figure 7:
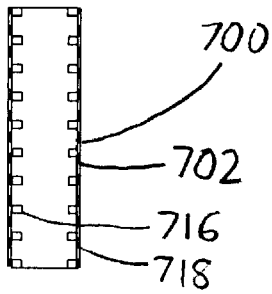
FIG. 7 is a schematic view of a cross-section of another porous emulsion tube 700 exemplifying the invention, wherein the tubular body 702 is formed of a mesh lattice/framework 716 with a porous skin 718 wrapped about the framework 716.

Expanding on the foregoing discussion, it should be understood that the various versions of the invention discussed above are merely exemplary, and the invention includes other variations as well. As an example, the tubular body of the emulsion tube need not necessarily be formed of metal, and could instead be formed of (for example) ceramic, or potentially even plastic (provided such plastic can withstand engine temperatures and prolonged exposure to fuel). Emulsion tubes made of more than one material, and/or composite structures, are also a possibility, e.g., an emulsion tube having a sintered metal entryway and a plastic section extending into the venturi, or having a ceramic entryway and a metal section extending into the venturi. FIG. 7 illustrates an emulsion tube 700 of this nature wherein a tubular lattice/framework 716 (e.g., one made of metal or plastic) is wrapped with a porous textile skin 718 (e.g., one made of carbon or glass fiber), with the skin 718 being bonded to the framework. Moreover, porosity may be made to vary about the outer skin 718 by varying its weave, and/or by stretching/elongating parts of the textile, so that the pores/spaces between adjoining fibers vary as desired. It should also be understood that the pores need not be present upon initial manufacture of the tubular body of the emulsion tube; for example, they might be formed via laser machining after the tubular body is initially molded, cast, or otherwise formed.

The various foregoing emulsion tubes can incorporate other features as well, e.g., protruding threading or teeth, and/or sockets or other indentations, which allow the emulsion tubes to be firmly installed within (and readily removed from) the carburetor. As an example, some carburetors utilize emulsion tubes having threaded ends which screw into sockets for easy installation of the emulsion tubes. An appropriately designed emulsion tube in accordance with the present invention might be formed to be threaded into such sockets as a replacement for conventional emulsion tubes.

As noted previously, the pores preferably have an average diameter of less than 100 micrometers. By this it should be understood that some pores may have diameters of greater than 100 micrometers and some may have diameters of less than 100 micrometers, but when all diameters are averaged together, they are preferably less than 100 micrometers. Experiments with a sintered bronze tubular body have found that good results arise with pore sizes on the order of about 20 micrometers (on average), but since only limited experimentation has been conducted as of the date that this document was first prepared, this should not be construed as suggesting that other sizes might not work as well. It is believed that pore diameters of less than 50 micrometers (and more specifically at ranges of around 10-40 micrometers) may be particularly useful.

Figure 1:
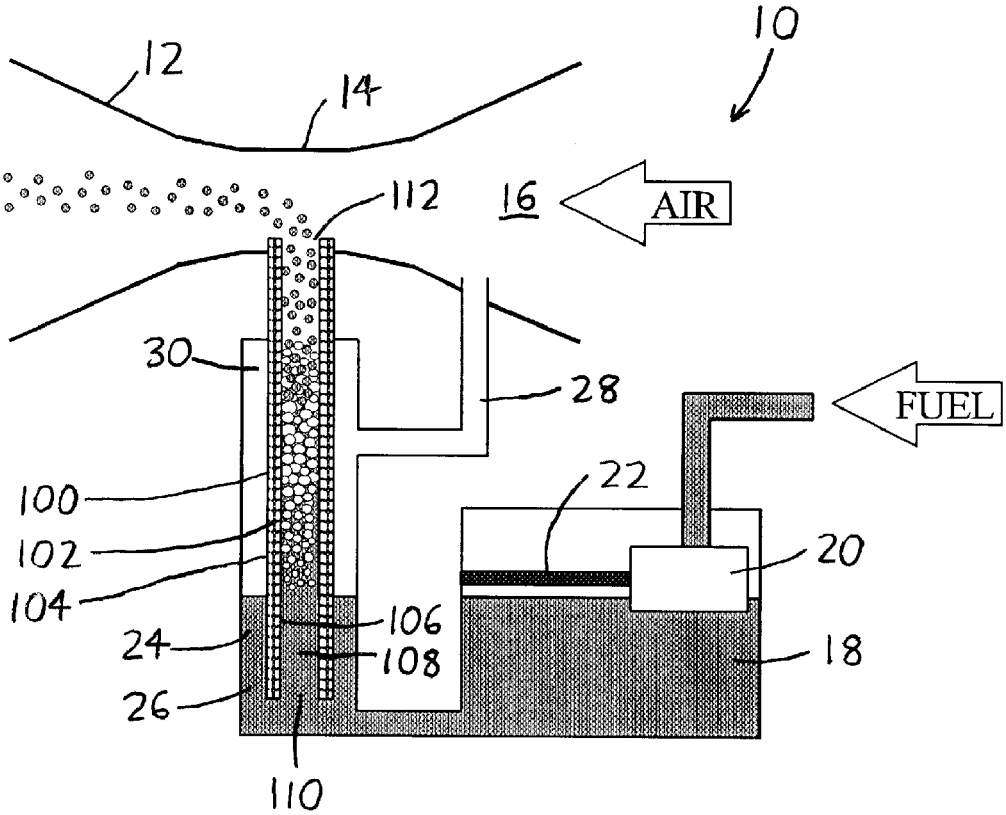
FIG. 1 is a schematic view of a cross-section of a carburetor 10 incorporating a porous emulsion tube 100 which exemplifies the invention, wherein the emulsion tube 100 extends from a fuel supply 18 to a venturi 12, with a section of the emulsion tube 100 between its first opening 110 and second opening 112 being exposed to an air supply 16.
Figure 2:
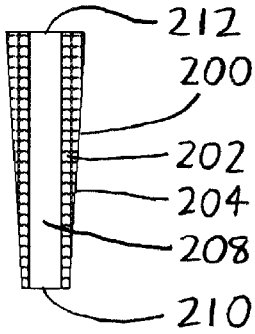
FIG. 2 is a schematic view of a cross-section of another porous emulsion tube 200 exemplifying the invention, wherein the outer diameter of the emulsion tube 200 varies between its first opening 210 and second opening 212 to provide variable resistance to air and/or fuel admittance along its length.
Figure 3:
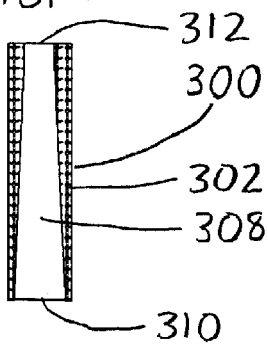
FIG. 3 is a schematic view of a cross-section of another porous emulsion tube 300 exemplifying the invention, wherein the diameter of the inner passage 308 of the emulsion tube 300 varies linearly between its first opening 310 and second opening 312 to provide variable resistance to air and/or fuel admittance along its length.
Figure 4:
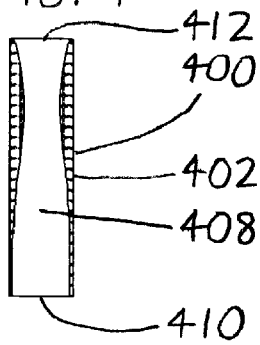
FIG. 4 is a schematic view of a cross-section of another porous emulsion tube 400 exemplifying the invention, wherein the diameter of the inner passage 408 of the emulsion tube 400 varies nonlinearly between its first opening 410 and second opening 412 to provide variable resistance to air and/or fuel admittance along its length.
Figure 5:
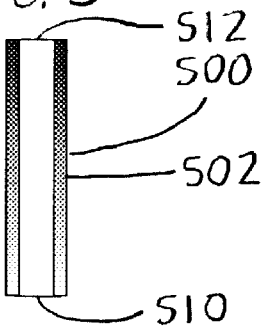
FIG. 5 is a schematic view of a cross-section of another porous emulsion tube 500 exemplifying the invention, wherein the porosity of its tubular body 502 varies in pore size and/or density between its first opening 510 and second opening 512 to provide variable resistance to air and/or fuel admittance along its length.
Figure 6:
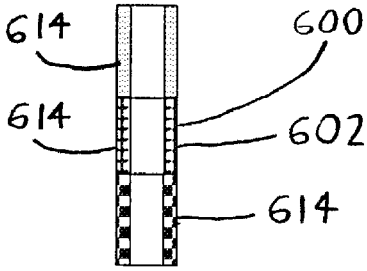
FIG. 6 is a schematic view of a cross-section of another porous emulsion tube 600 exemplifying the invention, wherein the tubular body 602 of the emulsion tube 600 is formed in discrete sections 614, each having a different average pore size and/or density, to provide variable resistance to air and/or fuel admittance along the length of the tubular body 602.

The carburetor 10 in FIG. 1 is merely a simplified exemplary carburetor, and it should be understood that emulsion tubes in accordance with the invention may be used in a wide variety of carburetors having vastly different configurations, including those of the type wherein air is supplied through the inner passage of the emulsion tube to aerate a surrounding body of fluid. The configuration of the emulsion tube may also vary; for example, it need not necessarily extend along a linear path, nor need it have a circular cross-section, though such configurations are preferred since conventional emulsion tubes generally have these features.

In addition, while the invention was previously described as being preferred for use in small SI engines, the invention is not limited to such uses. As an evident example, the invention is readily usable in large SI engines, though the current trend is away from the use of carburetion (and toward fuel injection) in such engines. The invention may also be used for carburetion in non-SI engines and other engines/motors. For example, many gas turbine engines have carburetion systems wherein emulsion tubes—which, in the gas turbine context, are more often referred to as atomizers, injectors, or injection nozzles—provide fuel to a supply of air leading to the combustion chamber/passage, and the invention is suitable for use in these types of carburetors as well.

The invention is not intended to be limited to the preferred versions of the invention described above, but rather is intended to be limited only by the claims set out below. Thus, the invention encompasses all different versions that fall literally or equivalently within the scope of these claims.

What is claimed is:

1. A carburetor for an engine including an emulsion tube with an elongated tubular body, the tubular body having an outer surface, an opposing inner surface surrounding an inner passage, and opposing first and second openings between which the inner passage extends, wherein at least a portion of the tubular body is porous, with a. multiple pores extending between the inner surface and outer surface, and b. the pores having an average diameter of less than about 100 micrometers.

2. The carburetor of claim 1 wherein the thickness of the tubular body, as measured between its inner and outer surfaces, is greater at the second opening than at the first opening.

3. The carburetor of claim 2 wherein the outer surface decreases in diameter between the first opening and the second opening.

4. The carburetor of claim 1 wherein the average diameters of the pores decrease over the tubular body as it extends from its first opening to its second opening.

5. The carburetor of claim 1 wherein the tubular body is formed of two or more axially aligned tubes situated in abutment.

6. The carburetor of claim 5 wherein at least two of the tubes have pores of different average diameter, with one of the tubes having an average pore diameter at least 3 micrometers greater than the average pore diameter of an adjacent tube.

7. The carburetor of claim 1 wherein the pores have an average diameter of less than 50 micrometers.

8. The carburetor of claim 1 wherein the pores have diameters between 10-40 micrometers.

9. The carburetor of claim 1 wherein the tubular body is at least partially formed of sintered metal.

10. The carburetor of claim 1 further including:

a. a fuel supply situated at one of the first and second openings, and b. an air supply about at least a portion of the outer surface, wherein the air supply is at an air pressure such that air is urged from the outer surface into the inner passage.

11. The carburetor of claim 1 further including a fuel supply and a venturi having a narrowed throat, wherein the inner passage of the tubular body extends between the venturi and the fuel supply with the first opening receiving fuel from the fuel supply and the second opening supplying fuel to the venturi.

12. The carburetor of claim 11 wherein:

a. the second opening of the tubular body opens onto the narrowed throat of the venturi, and b. the carburetor further includes a high-pressure air passage leading between:

(1) an area of the tubular body between its first and second openings, and (2) a high-pressure area situated upstream or downstream from the narrowed throat of the venturi.

13. The carburetor of claim 12 wherein the outer surface of the tubular body has lesser diameter at the first opening than at the second opening.

14. The carburetor of claim 12 wherein the average diameters of the pores vary in relation to their distance from the first opening.

15. The carburetor of claim 12 wherein the tubular body is formed in two or more tubular sections, wherein at least one of the tubular sections has an average pore diameter which is at least 3 micrometers greater than the average pore diameter of an adjacent tubular section.

16. The carburetor of claim 12 wherein the pores have an average diameter of less than 100 micrometers.

17. The carburetor of claim 12 further comprising:

a. a fuel supply supplying fuel to the emulsion tube, and b. an air supply supplying air between the inner surface and the outer surface of the tubular body of the emulsion tube.

18. The carburetor of claim 12 further including a fuel supply and a venturi having a narrowed throat, wherein the first opening of the tubular body is in fluid communication with the fuel supply and the second opening of the tubular body is in fluid communication with the venturi.

19. The carburetor of claim 17 wherein the pores in the tubular body have an average diameter of less than 0.5 mm.

20. The carburetor of claim 17 wherein the pores in the tubular body have an average diameter of less than about 100 micrometers.

21. A carburetor for an engine including an emulsion tube with an elongated tubular body, the tubular body having an outer surface, an opposing inner surface surrounding an inner passage, and opposing first and second openings between which the inner passage extends, wherein at least a portion of the tubular body is formed of sintered material having pores extending between the inner surface and outer surface, with the pores having an average diameter of less than 0.5 mm.

22. A carburetor for an engine including:

a. a venturi having a narrowed throat, b. a fuel supply, b. an air supply, c. a sintered metal emulsion tube with an elongated tubular body, the tubular body having an outer surface and an opposing inner surface surrounding an inner passage, wherein:

(1) the inner passage extends between a first opening in fluid communication with the fuel supply and a second opening in fluid communication with the venturi, (2) pores extend through the tubular body from the outer surface to the inner surface to open upon the inner passage, and (3) the air supply is situated about at least a portion of the outer surface, and is at a pressure sufficient to urge air through the outer surface and into the inner passage.

* * * * *

UNITED STATES PATENT AND TRADEMARK OFFICE

CERTIFICATE OF CORRECTION

PATENT NO. : 7,472,894 B2
APPLICATION NO. : 11/426946
DATED : January 6, 2009
INVENTOR(S) : Timothy A. Shedd, Wayne I. Staats and Terry L. Hendricks It is certified that error appears in the above-identified patent and that said Letters Patent is hereby corrected as shown below:

Please correct the federal grant/funding clause at column 1 line 9 delete:

"The United States has certain rights in this invention."

col. 1 line 9 and substituting therefor:

The United States government has certain rights in this invention.

Signed and Sealed this

Twenty-fourth Day of March, 2009

John Doll

JOHN DOLL
*Acting Director of the United States Patent and Trademark Office*